United States Patent [19]

Luke et al.

[11] Patent Number: 4,693,308

[45] Date of Patent: Sep. 15, 1987

[54] TUBING CONVEYED PERFORATING SAFETY ANCHOR

[75] Inventors: Robert R. Luke, Houston; James M. Barker, Katy, both of Tex.

[73] Assignee: Halliburton Company, Duncan, Okla.

[21] Appl. No.: 810,635

[22] Filed: Dec. 19, 1985

[51] Int. Cl.[4] ..... E21B 31/18

[52] U.S. Cl. ..... 166/55.1; 166/98; 166/301; 175/4.56

[58] Field of Search ..... 166/55.1, 55, 98, 297, 166/301, 178, 209; 175/4.52, 4.56, 230

[56] References Cited

U.S. PATENT DOCUMENTS 2,287,319 6/1942 Miller ..... 166/178

4,488,597 12/1984 Hoppe et al. ..... 166/297

*Primary Examiner*—Stephen J. Novosad

*Assistant Examiner*—Terry Lee Melius

*Attorney, Agent, or Firm*—William J. Beard

[57] ABSTRACT

In a tubing conveyed perforating gun assembly, a detonator is discharged by a weight bar dropped into the tubing string, subject to unintended sticking. The disclosed safety anchor includes a rope socket enabling the safety anchor to be lowered into the tubing string. The safety anchor has an elongate body connected below the rope socket by a shear pin. The body has a mandrel and sleeve construction cooperatively connected with a bottom located grapple cage around collet fingers enabling a fishing neck on the weight bar to be grasped and firmly held. A slip radially expands to lock the safety anchor in the tubing string, enabling the weight bar to be held against falling for safe retrieval.

16 Claims, 3 Drawing Figures

TUBING CONVEYED PERFORATING SAFETY ANCHOR

BACKGROUND OF THE DISCLOSURE

When a well has been drilled and the completion procedure is initiated, one of the important steps is to install tubular members in the well. They are extended past the formation thought to have oil and gas. The oil and gas is produced into the well through perforations which are formed in the tubular member. The perforations are frequently formed by a tubing conveyed perforating assembly, hereinafter referred to as "TCP". The TCP system is lowered into the well on a tubing string. The tubing string is inserted into the well to land the TCP at a specified depth. The designated depth positions the TCP system spanning the formation of interest so that the perforations are formed at the proper depth. The tubing is a small diameter tubing string assembled joint by joint and lowered into the well. After the tubing string has been placed in the well, a weight bar is dropped down the tubing. It travels through the tubing to strike the top of the TCP system to trigger detonation, thereby operating the shaped charges inside the perforating guns. They form perforations into the adjacent formation to enable production.

The weight bar must fall to the bottom of the tubing string to initiate perforation. If it is stalled during the free fall, there is no detonation. The weight bar can be stopped by pipe scale, pipe dope on the inside, drilling fluids in the tubing string, kinks or bends in the tubing string or other reasons. If the weight bar falls partially, but not completely through the tubing string, the stuck weight bar must be retrieved before the TCP is retrieved. Otherwise, there is the risk that the weight bar may be jarred free while retrieving the tubing string and thereby detonate the TCP in the wrong location downhole. This has occurred in times past, namely the perforating guns have been fired at the wrong depth in the well. The perforations were formed at the wrong depth.

To overcome this risk, the present disclosure sets forth a slick line supported device which will be termed a safety anchor. It is run into the tubing string to latch onto the stuck weight bar. The slick line is then retrieved, leaving the safety anchor and weight bar in the tubing held at a locked location. The safety anchor then prevents further fall of the weight bar. The tubing string can then be retrieved from the well without fear that the weight bar will drop, detonating the perforating guns, and forming perforations at the wrong depth in the well.

In summary, the apparatus of the disclosure includes a slick line supported rope socket fitting connected to a setting sub supporting a detachable mandrel. The mandrel is detachable by shearing a shear pin. A fishing neck on the weight bar is clamped by a grapple supported below the mandrel, and radially expandable external slips grip the interior of the tubing string when a shear pin in broken.

DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
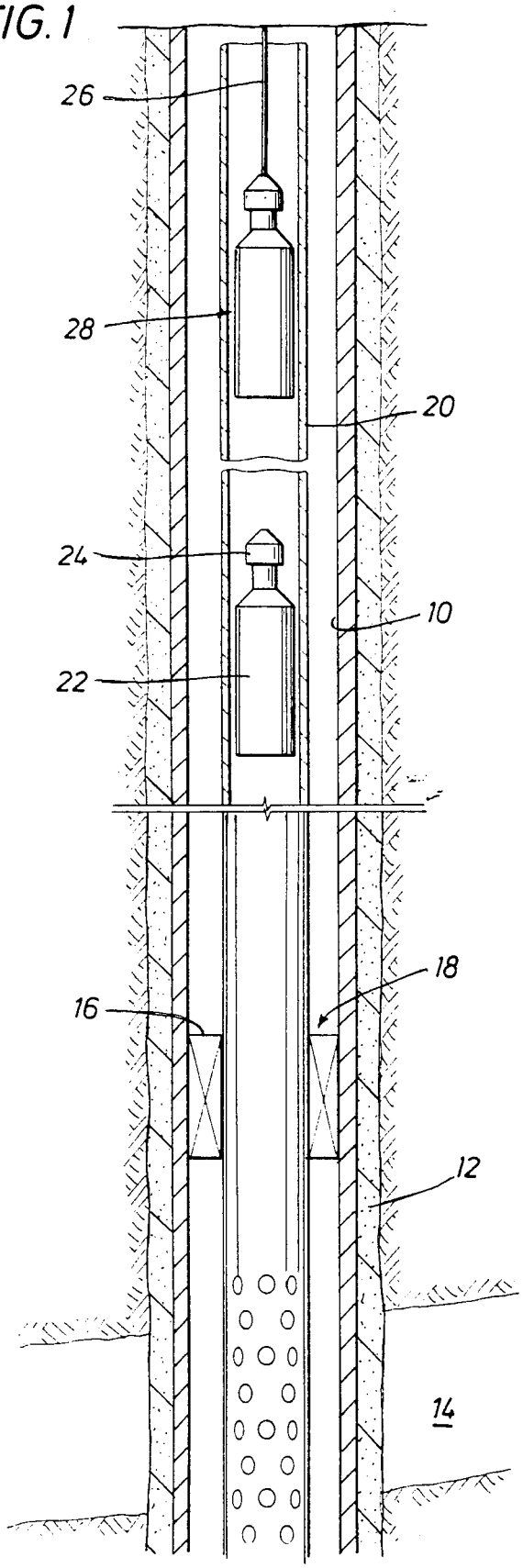
FIG. 1 is a sectional view through a well where perforating guns are located to perforate into a specific formation, therebeing a tubing string in which a stuck weight bar is caught, and further showing the safety anchor of the present disclosure supported on a slick line for locking to the stuck weight bar.

Attention is first directed to FIG. 1 of the drawings which shows a well during completion. In the well, a casing 10 is anchored in the well by an external cement 12 to enable perforations into a zone 14. Assume for illustrative purposes that the zone 14 is a productive zone which is to be produced through perforations flowing into the well. A TCP anchor 16 is positioned in the casing at a specified depth. The depth can easily be several thousand feet. The TCP 18 is supported on the anchor 16. The TCP is constructed with a number of shaped charges which are directed radially outwardly to form perforations into the formation 14. The TCP 18 includes a detonator. The detonator is a device well known in the art, and is adapted to ignite a primer cord when a weight bar strikes the detonator mechanism. The TCP 18 is connected to the surface through a tubing string 20. The TCP string is not coiled or spaghetti tubing. Typically, it is relatively small diameter tubing.

The numeral 22 identifies a weight bar. It is an elongate cylindrical body having a fishing neck 24. It has a weight calculated to operate the detonator in the TCP system, thereby triggering the firing sequence where the perforations are formed. The weight bar might weigh upwards of 100 pounds. It is equipped with the fishing neck 24 constructed in accordance with an industry standard to enable retrieval.

The present apparatus is intended to attach a safety anchor to the fishing neck 24 and lock in the tubing string, and thereby prevent sudden release of the weight bar. The bar 22 can stick, caused by a multitude of problems of all types. The problems causing sticking are many and varied; suffice it to say, the weight bar 22 may stick. Assume for purposes of illustration that the TCP is located at 10,000 feet depth. Assume that the weight bar 22 sticks at 6,000 feet. The present apparatus enables a safety anchor to be attached to the weight bar 22 to thereby prevent further fall of the weight bar. Otherwise, the weight bar might become accidentally freed during the retrieval of the tubing string and proceed downward to fire the guns at the wrong location.

The retrieval apparatus of the present disclosure is identified by the numeral 28, it being supported on a slick line 26. The slick line is used to lower the safety anchor to the weight bar. It is run into the tubing until it lands on the stuck weight bar. If the weight bar is dislodged, it will then fall presumably to the bottom and detonate the TCP guns at the required depth in the well obtaining the desired result. On the other hand, if the weight bar is not dislodged, the fishing neck 24 is grasped and an upward tug is attempted. Once the slick line and safety anchor are secured to the weight bar, the weight bar may be retrieved if the sticking can be overcome. If this is accomplished, the weight bar can then be retrieved and perhaps an alternate weight bar can be substituted. If retrieval is achieved, perhaps the sticking problem can then be overcome so that a second drop is performed, ultimately detonating the shaped charges in the intended fashion.

Figure 2:
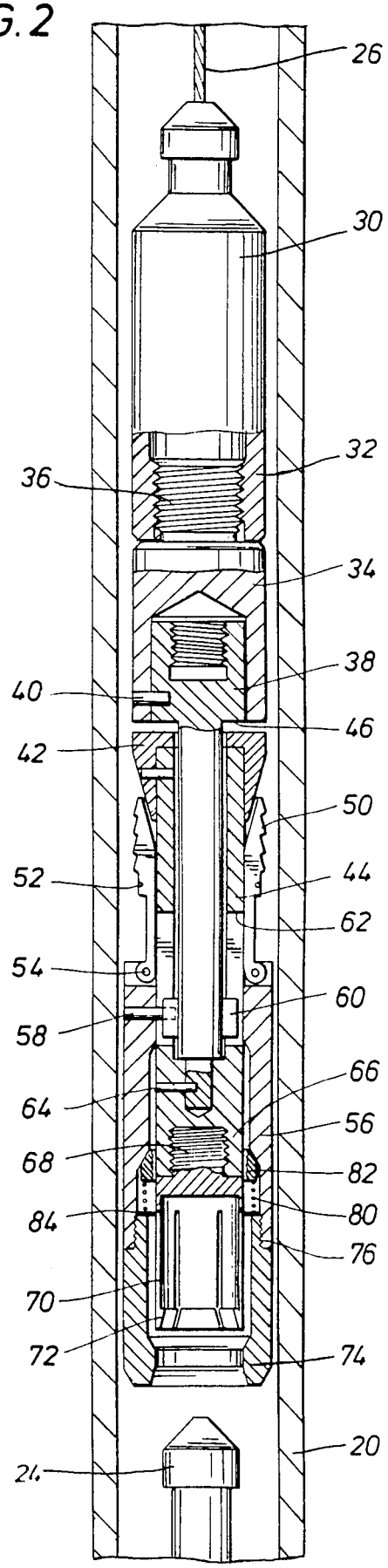
FIG. 2 is a sectional view through the safety anchor supported on a slick line in the running position to enable travel along the tubing string.

The possibility exists, however, that the weight bar 22 is stuck at a specified depth as shown in FIG. 1 and cannot be retrieved. If that is the fact, the present apparatus is lowered so that the safety anchor attaches to the fishing neck 24, the slick line is then pulled, a shear pin broken, and the safety anchor then expanded to lock against the tubing, thereby forbidding subsequent release of the weight bar. Operation of the apparatus begins with a description of FIG. 2. There, the apparatus will be described proceeding from top to bottom.

The slick line 26 connects with a slick line rope socket 30 which has an internally threaded skirt 32 which threads to the matching threads on a setting sub 34. The sub 34 includes the narrow neck 36. It is threaded on the exterior. In turn, the setting sub fastens to a mandrel 38. They are joined together by a shear pin 40. The shear pin is selected to enable pull on the slick line to sever the shear pin. Operation of this shear pin in conjunction with others will be detailed hereinafter. The shear pin 40 is thus shown fastening the setting sub 34 to the mandrel 38.

The mandrel 38 has a downwardly facing shoulder immediately adjacent to an external tapered wedge 42. The wedge 42 is secured to a mounting sleeve 44. The sleeve telescopes around the mandrel and moves along the mandrel in a fashion to be described. The sleeve 44 is surrounded on the exterior by a set of collet fingers. The fingers terminate at enlargements 50 which are serrated. The serrations define external slips which grip the tubing 20. The enlargements are forced inwardly by means of a surrounding garter spring 52. They are forced outwardly by action of the wedge 42 which has a tapered, conic outer face. The angle of the wedge conforms with the internal tapered face on the back of the enlargements 50, thereby enabling the wedge to drive the collet fingers 48 radially outwardly into gripping contact with the tubing string 20. Each collet finger is supported by a pin 54 for rotation as will be described.

The pin 54 passes through the upper end of a sleeve shaped slip retainer 56. The slip retainer fits around the mandrel and rides over the sleeve 44. The slip retainer 56 is joined to the mandrel 38 by a shear pin 58. The mandrel includes an enlargement or boss 60. The boss serves as a guide for the sleeve 44. The sleeve is slotted, the slot terminating at the slot end 62 shown in FIG. 2. The slot is open ended at the upper end for assembly purposes. The slot parallels the boss 60 to enable the mandrel to telescope upwardly within the sleeve. Conveniently, the boss 60 is duplicated on opposite sides of the mandrel.

The sleeve is pinned to the mandrel by means of a shear pin 64. The shear pin 64 temporarily secures the mandrel against movement within the sleeve. The sleeve terminates with an internally threaded skirt 66, and a grapple is threaded to it. The grapple includes a neck 68 which matches the threads. It is constructed with an axially hollow skirt cut with lengthwise slots to define deflectable grapple fingers 70. They are deflectable by virtue of their length and relatively narrow width. They terminate at under cut hooks 72 to grab the fishing neck 24. They are unable to deflect outwardly with limits. The range of deflection is outwardly determined by a surrounding grapple cage 74. The grapple cage 74 is sized so that the fingers may deflect radially outwardly sufficient to ride over the fishing neck to latch underneath. The grapple cage 74 has an internal enlargement at the lower end with appropriate tapered faces, thereby assuring the proper deflection of the collet fingers defining the grapple. This enables the device to grab and secure the fishing neck 24. The grapple cage 74 is formed from cylindrical stock. It is threaded to the slip retainer at a threaded connection 76. The threaded connection 76 can be unthreaded to enable installation of a spring 80.

The spring 80 bears against an internal slip 82 thereabove. Below, a bushing 84 supports the spring. The bushing 84 is positioned above the sleeve forming the grapple cage.

Figure 3:
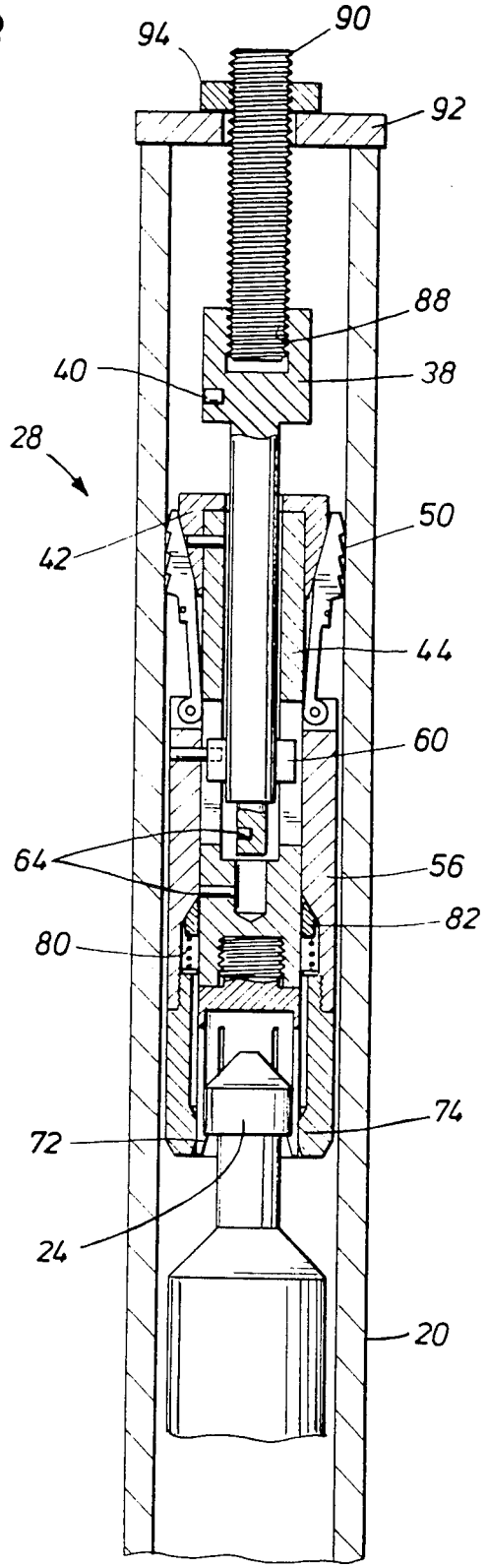
FIG. 3 is a sectional view through the set safety anchor locked in a tubing string.

In fact, FIG. 3 shows the equipment after the safety anchor 28 has been installed in the tubing 20. The sequence of operation requires shearing of the shear pins in a particular sequence. Attention is momentarily focused on the shear pin 64. It is the first pin which is sheared and is therefore set for the lightest shear load. The safety anchor 28 is run into the well in the tubing 20 until the stuck bar 22 is encountered. It is dropped with some force onto the stuck weight bar. It may jar the weight bar free to fall to the bottom and trigger the TCP perforation sequence. If not, it is dropped on the stuck bar with sufficient force to jam the fishing neck 24 into the grapple fingers causing the fishing neck to be latched. Upward pull, or jarring, on the mandrel shears the pin 64. The shear pin 64, once sheared, releases the mandrel so that an upward pull can be applied to the safety anchor. When the mandrel moves up, the grapple fishing neck 24 is held by the grapple cage 74.

Also, moving with the mandrel are the collet fingers, slip retainer 56, grapple cage 74, bushing 84, spring 80, and internal slips 82. Note that the internal slips are actually tapered wedges that allow upward, but not downward, movement of the mandrel and attached parts. As the mandrel is pulled upward, the collet fingers are forced radially outwardly as they slide up the tapered wedge 42.

Thus, the collet fingers are forced under wedge action against the tubing 20 and lock the safety anchor at that point in the tubing string. That is, the stuck bar is no longer free to fall. Once locked, it is held in position. Once locked, the slip serrations (preferably cut to bias against further downward movement) hold against downward movement. This assures that the slips hold and prevent the safety anchor from sliding in the tubing string. Because the internal slips 82 prevent downward mandrel movement, they also prevent the collet fingers from sliding back down the tapered wedge 42.

Attention is now directed to the shear pin 40. It is set to shear at a force which is perhaps two or three fold greater than the force required to shear the pin 64. Once the tool is anchored in location, an upward pull is taken on the slick line 26 and the shear pin 40 is broken. This enables retrieval of the rope socket 30 and the setting sub 34. This enables the slick line to be retrieved completely from the tubing string. Moreover, retrieval of the slick line clears the tubing string of obstruction to make tubing retrieval much easier. Otherwise, it would be difficult to retrive the tubing string with the slick line 26 in it. There is a third and shear pin located at 58. It requires a larger shear force and is normally broken only upon tool disassembly.

As further shown in FIG. 3 of the drawings, the mandrel terminates with an exposed internally threaded socket 88 shown in FIG. 3 of the drawings. This is used during removal. A threaded member 90 is placed in the tubing just above the stuck safety anchor 28. It is threaded into the anchor by rotation. Afterwards, a backup plate 92 is abutted against the end of the tubing, and a nut 94 is rotated to drive the backup plate against the tubing 20. This pulls the mandrel upwardly to shear the pins 58. Further upward movement of the mandrel pulls the wedge from under the collet fingers. The tool is now released. Representative shear forces typically required for the pins are about 150 pounds for the pin 64 and approximately two or three fold for the shear pin 40. The pin 58 shears at approximately 3000 pounds. Thus, the pins are sheared in sequence dependent on their strength, the weaker pin being sheared first.

The present apparatus is used in the described manner, namely by lowering on the slick line 26 into the tubing string 20. Once latching is achieved, the fishing neck 24 is secured against slippage by utilizing an upward jar to shear pin 64, accomplishing locking. The upward pull on the wireline retrieves the wireline by shearing the pin 40. This avoids accidental dropping on the stuck weight bar 22 during tubing retrieval.

While the foregoing is directed to the preferred embodiment, the scope is determined by the claims which followed.

What is claimed is:

1. In a tubing conveyed perforating gun assembly supported at the lower end of a tubing string and adapted to be fired by a dropped weight bar with fishing neck falling through the tubing string, subject to sticking before initiating detonation of the charges in the tubing conveyed perforating gun assembly, a safety anchor comprising:

(a) an elongate body having connecting means for connection with a supportive wireline enabling said elongate body to be lowered in the tubing string;

(b) fishing neck grapple means supported at the lower end of said elongate body for engaging the fishing neck on the weight bar stuck in the tubing string;

(c) means disconnecting said wireline from said body at said connecting means;

(d) radially expandable slip means on said body and adapted to engage the wall of the tubing string connected to the tubing conveyed perforating gun assembly to secure said body at a specified location along the tubing string to prevent further movement there along during retrieval of the tubing string from the well while supporting the stuck weight bar therebelow;

(e) wherein said body includes:

(1) a central mandrel;

(2) an elongate sleeve telescoped around said mandrel for sliding axial movement;

(3) a set of encircling collet fingers comprising said grapple means;

(4) a surrounding grapple cage about said collet fingers sized to clamp said fingers radially inwardly to clamp the fishing neck; and (5) means connected to said grapple cage for relatively positioning said grapple cage to enable movement to a locking position relative to said collet fingers.

2. The safety anchor of claim 1 further including a rope socket at the top end of the said elongate body joined thereto by a shear pin to enable said rope socket to be retrieved with the wireline.

3. The safety anchor of claim 1 including inwardly pointed hooks on said fingers for grasping the fishing neck.

4. The safety anchor of claim 1 including a compressible spring means moving said grapple cage between fishing neck engaging and disengaging positions.

5. The safety anchor of claim 1 including means centrally within said fingers for limiting penetration of the fishing neck.

6. The safety anchor of claim 1 including shearable means releasably fastening said central mandrel to said sleeve.

7. The safety anchor of claim 1 including cooperative slot means and mating means extending into said slot means for locking said mandrel and said sleeve against rotation while permitting linear, telescoping movement therebetween.

8. The safety anchor of claim 1 including a threaded joint between said grapple cage and said sleeve enabling disassembly there at, and further including a compressed coil spring inserted axially of said sleeve.

9. In a tubing conveyed perforating gun assembly supported at the lower end of a tubing string and adapted to be fired by a dropped weight bar with fishing neck falling through the tubing string, subject to sticking before initiating detonation of the charges in the tubing conveyed perforating gun assembly, a safety anchor comprising:

(a) an elongate body having connecting means for connection with a supportive wireline enabling said elongate body to be lowered in the tubing string;

(b) fishing neck grapple means supported at the lower end of said elongate body for engaging the fishing neck on the weight bar stuck in the tubing string;

(c) means disconnecting said wireline from said body at said connecting means;

(d) radially expandable slip means on said body and adapted to engage the wall of the tubing string connected to the tubing conveyed perforating gun assembly to secure said body at a specified location along the tubing string to prevent further movement there along during retrieval of the tubing string from the well while supporting the stuck weight bar therebelow;

(e) wherein said body includes:

(1) a central mandrel;

(2) an elongate sleeve telescoped around said mandrel for sliding axial movement;

(3) elongate, deflectable collet fingers terminating in serrated enlargements for gripping contact with the tubing string and comprising said slip means; and (4) a circular, wedge shaped member axially movable on relative movement between said mandrel and said sleeve, said wedge member moving axially adjacent to said collet fingers to move said fingers radially outwardly to secure the safety anchor in the tubing string.

10. The safety anchor of claim 9 including deflectable connecting means fastening said collet fingers for pivotal movement, and further including resilient means biasing said collet fingers radially inwardly.

11. The safety anchor of claim 9 including means limiting radially inward movement of said collet fingers.

12. The safety anchor of claim 9 including shearable means releasably securing said mandrel and said sleeve prior to radial outwardly movement thereof.

13. The safety anchor of claim 9 including cooperative slot means and mating means extending into said slot means for locking said mandrel and said sleeve against rotation while permitting linear, telescoping movement therebetween.

14. The safety anchor of claim 9 including a protruding, upper end located connector on said mandrel enabling a retrieval tool to be connected to said mandrel.

15. The safety anchor of claim 9 further including:

(a) a second set of encircling collet fingers comprising said grapple means;

(b) a surrounding grapple cage about said second collet fingers sized to clamp said fingers radially inwardly to clamp the fishing neck; and (c) means connected to said grapple cage for relatively positioning said grapple cage to enable movement to a locking position relative to said second collet fingers.

16. The safety anchor of claim 15 including cooperative slot means and mating means extending into said slot means for locking said mandrel and said sleeve against rotation while permitting linear, telescoping movement therebetween.

* * * * *